US005387144A

United States Patent [19]

Aso et al.

[11] Patent Number: 5,387,144

[45] Date of Patent: Feb. 7, 1995

[54] STABILIZER FOR SPAR BUOY

[75] Inventors: Hiroshi Aso; Tadahiro Arimura; Junichi Harada, all of Osaka; Mikio Fukutomi, Tokyo; Mitsuaki Yokomine, Tokyo; Tsuyoshi Nakazawa, Tokyo, all of Japan

[73] Assignee: Zeni Lite Buoy Co., Ltd., Osaka, Japan

[21] Appl. No.: 115,842

[22] Filed: Sep. 2, 1993

[30] Foreign Application Priority Data

Sep. 19, 1992 [JP] Japan ..... 4-275537

[51] Int. Cl.[6] ..... B63B 22/18

[52] U.S. Cl. ..... 441/22; 441/23

[58] Field of Search ..... 441/3-5, 441/21-23; 114/126, 264

[56] References Cited

FOREIGN PATENT DOCUMENTS

| | | | |
|---|---|---|---|
| 0079788 | 6/1980 | Japan | 441/21 |
| 0157683 | 12/1981 | Japan | 441/21 |
| 0157684 | 12/1981 | Japan | 441/21 |
| 404015184 | 1/1992 | Japan | 441/21 |

*Primary Examiner*—Sherman Basinger
*Attorney, Agent, or Firm*—Koda and Androlia

[57] ABSTRACT

A spar buoy is so arranged that a buoyancy body (1) is provided halfway on a marker mast (2), the lower end of the marker mast (2) being moored to a sinker (7) sunk at water bottom by a mooring device (6) and that the buoyancy body 1 is pulled in the water so that the water line comes to halfway on the marker mast (2) above the buoyancy body (1), the spar buoy comprising at least two arms (8, 8) protruded in opposite directions to each other from the marker mast (2) below the buoyancy body (1), and blades (9, 9) attached to the end of each arm (8) so as to have a positive angle of attack α toward the center of the buoy.

4 Claims, 9 Drawing Sheets

STABILIZER FOR SPAR BUOY

BACKGROUND OF THE INVENTION

1. Field of the Invention

The present invention relates to a device for suppressing or preventing a spar buoy installed in the water from inclining or yawing due to tidal currents, waves, and the like.

2. Description of the Prior art

Pull-in mooring type spar buoys, which are so arranged that a buoyancy body is provided halfway on a marker mast, the bottom end of the marker mast being moored to a sinker sunk at a water bottom by a mooring device, and that the buoyancy body is pulled in the water so that the water line comes halfway of the marker mast above the buoyancy body, thus allowing the spar buoy to erect in the water by buoyancy, are less in separation length and relatively less in yawing. Therefore, they have been used in navigational aids, boring equipment, and the like.

However, the marker mast is erect over a range from nearly the water bottom to the water surface in installation, thus subject to direct effect of tidal currents and waves, such that the spar buoy may incline or yaw. When the spar buoy is used in relatively shallow waters, the spar buoy will more likely undergo such inclination and yawing.

For example, referring to a case where a mooring rope is used as the mooring device, the spar buoy is normally urged upward by buoyancy, giving rise to a possibility that the spar buoy may show two modes of yawing as shown in FIGS. 5 and 6. Mode 1 yawing (FIG. 5) is a pitching about the spar buoy's center of gravity, while Mode 2 yawing (FIG. 6) is a pitching about the mooring point. When another mooring device is used, there may occur another yawing that the spar buoy turns about its center axis.

The natural period of these types of yawing of the spar buoy, differing depending on water depth (i.e. size of the spar buoy) and the mooring device's length, is, for example, 2–3 sec. for the pitching in Mode 1 and 18–20 sec. for the pitching in Mode 2, in the case of a 20 m water depth and a 2 m mooring rope length.

The shallower the water depth, the shorter the natural period of Mode 2, while the shorter the mooring rope length, the shorter the natural period of Mode 1.

The Mode 1 pitching (FIG. 5) will not occur when the mooring device used is a direct-coupled mooring type such as universal joint (rope length: 0). Conversely, it may occur when such a mooring device as a short chain is used in order to facilitate control of water depth or to facilitate installation and relocation for use of boring.

Also, the spar buoy may incline when undergoing a resistance to water currents such as tidal currents. Slow water currents, which cause the spar buoy to less incline, are negligible. However, a little faster water currents will cause a greater inclination, such that a beacon-use spar buoy may result in an inclined lamp and therefore in its deteriorated function as a beacon, or that a boring-use spar buoy may result in an inclined working scaffold with worsened workability.

Also, when a water current impinges upon the marker mast or the columnar portion of the buoyancy body, there may occur Karman vortices or flutters. Incident cycle of Karman vortices, differing depending on the diameter of marker mast and the flow velocity, is 3 to 4 sec. for a flow velocity of 3 knots and a marker mast diameter of 0.6 to 0.8 m. The flutters, on the other hand, will occur at the natural period of Mode 2. These phenomena will act on the spar buoy as a vibromotive force. Waves also act as a vibromotive force.

Accordingly, when the natural period of yawing of the spar buoy approaches the period of waves or the incident period of Karman vortices due to water currents, both the waves and the water currents being external forces, there will occur Mode 1 (FIG. 5) and Mode 2 (FIG. 6) yawing, which may impair the function as a spar buoy.

A means for suppressing the Mode 1 yawing (FIG. 5) out of the possible two types of yawing of the spar buoy may be to attach totally four sheets of resistance plates a to the marker mast in such a way that they are shaped into a planar cross (see FIG. 7). This arrangement allows the spar buoy to be prevented from Mode 1 yawing and besides suppressed to be inclined.

On the other hand, a means for suppressing the Mode 2 yawing (FIG. 6) may be to attach totally four sheets of resistance plates to the marker mast so that they are shaped into a planar cross, as in the above case, at a portion away from the center of yawing, for example underneath the draft point of the marker mast. With such an arrangement, although the damping force becomes larger, yet the spar buoy is more likely subject to grain movement due to waves, resulting in an increased possibility of yawing. Moreover, water-current resistance applies also to the resistance plates attached to the marker mast, causing the spar buoy to be further inclined. Thus, this means cannot be said proper for the suppressing means.

In particular, spar buoys installed in the seas shallower than a 20 m water depth become smaller in natural period of Mode 2 yawing (FIG. 6), such that it approximates to wave periods of design conditions (e.g. 8–12 sec.), entering the resonance range. However, there has been available no effective means for suppressing yawing in such a case up to now, which has been a problem.

Also, there has not been found out a way for suppressing or preventing the spar buoy's inclination due to water currents. Therefore, up to now, it has been considered impossible to provide such spar buoys as are subject to less inclination to both waves and currents.

SUMMARY OF THE INVENTION

Accordingly, it is a primary object of the present invention to suppress or prevent a spar buoy from inclinations due to water-current resistance by attaching a simple device to the spar buoy, and to provide a stabilizer for suppressing a spar buoy from yawing of Mode 1 (FIG. 5) and Mode 2 (FIG. 6) as well as such yawing that the spar buoy turns about its center axis, and also provide a device which facilitates the handling of the stabilizer.

The stabilizer of the present invention comprises: at least two arms 8, 8 protruded in opposite directions to each other from a marker mast 2 below a buoyancy body 1, and blades 9, 9 attached to ends of the arms 8, 8 so as to have a positive angle of attack $\alpha$ toward the center of the buoy.

Preferably, the arm 8 is provided with a hinge 10 for folding the arm 8 at its base portion, and a securing means 11 for securing the hinge 10 in such a state that the arm 8 is stretched laterally.

Also preferably, the blade 9 is arranged to be variable in its overall area.

The function of the present invention is now described with reference to FIGS. 1 through 4.

FIG. 1 is a side view showing a state in which a prior-art spar buoy is installed in a water current, illustrating a case where a restoring moment $M_P$ due to a buoyancy P and an overturning moment $M_F$ due to a water-current drag F are balanced at a tilt angle $\theta'$.

FIG. 2 is a side view showing a state in which a stabilizer equipped with the stabilizer according to the present invention is installed in a water current, illustrating a case where, by providing a positive angle of attack $\alpha$ to the blades 9, restoring moments $M_{L1}$, $M_{L2}$ due to lifts $L_1$, $L_2$ of the blades 9, a restoring moment $M_P$ due to a buoyancy P, a drag F of the spar buoy, and an overturning moment $M_t$ due to drags $D_1$, $D_2$ of the blades 9 are balanced so that a smaller tilt angle 8 results, thus the case being more stable than that of FIG. 1.

FIG. 3 illustrates a case where, by appropriately selecting the length of the arm 8, the area of the blades 9, and the angle of attach $\alpha$ of the blades 9 to the arm 8, a restoring moment $M_t$ and a restoring moment $M_L$ are balanced so that the spar buoy is perfectly stable.

On the other hand, FIG. 4 is a side view showing a state in which a spar buoy having blades 9' attached thereto is installed in a water current without providing an angle of attack to the arm 8, where lifts $L_1$, $L_2$ of the blades 9' act in such a way that moments $M_{L1}$, $M_{L2}$ cancels each other between upper and down stream sides, without restoring moments being generated, but with an overturning moment increased due to lifts $D_1$, $D_2$ of the blades 9', so that the spar buoy is greatly inclined (tilt angle: $\theta'$) as in FIG. 1. FIG. 4 implies that even if the blades 9' are attached without providing an angle of attack to the arm 8, the spar buoy cannot be restored from inclination, but will be increased in inclination. Therefore, it can be easily understood from this figure that restoring moments cannot be effective without providing a positive angle of attack $\alpha$ to the blades 9 as in the present invention.

It is noted that FIGS. 2 to 4 takes a case where the arm 8, 8 protruded in opposite directions to each other from the marker mast 2 are aligned with the direction of current. Taking this case, the principle of the stabilizer of the present invention is described hereinbelow.

Assume that the angle of attack of the blades 9 to the arm 8 is $\alpha$, the area of the blades 9 is $A_w$, the flow velocity of water current is V, the length of the arm 8 (distance from the lift center of a blade 9 to the center axis of the marker mast 2) is $l_1$, the projection area of the spar buoy below the water surface in the direction of current is $A_B$, the lift coefficient of the blades 9 is $C_L$, the lift coefficients of the blades 9 for a spar buoy's inclination of $\theta$ are $C_{L1}$, $C_{L2}$, the drag coefficient of the spar buoy is $C_B$, the drag is F, and the distance from the center about which the drag F acts to the mooring point is $l_2$.

To the blades 9, 9 there will occur lifts $L_1$, $L_2$ and drags $D_1$, $D_2$, respectively, where the drags $D_1$, $D_2$ are smaller than lifts $L_1$, $L_2$. A lift will occur vertically downward to the upstream side blade 9 as indicated by $L_2$ in FIGS. 2 and 3, and upward to the downstream side blade 9 as indicated by $L_1$ in FIGS. 2 and 3. Accordingly, due to these lifts $L_1$, $L_2$, restoring moments $M_{L1}$, $M_{L2}$ will act on the spar buoy in such a direction as to cancel its inclination. In addition, when arms are protruded also in opposite directions to each other orthogonal to the current and blades are attached respectively to ends of the arms at an angle $\alpha$, then the angle of attack of both blades to the water current is 0 (the same as in the spar buoy's erected state), where both blades undergo only drags (no lift occur), but the pressure-receiving area and drag coefficient are so small that the tilt moment even with the tilt moments due to the drags $D_1$, $D_2$ of the blades 9 on the flow-direction side added thereto is substantially smaller than the restoring moment $M_L$. Therefore, the fluid force that acts on the blades 9 on the flow-direction side acts on the spar buoy as a restoring force, with the result of a reduced inclination angle.

Relations among the drag F of the spar buoy, lifts $L_1$, $L_2$ of the blades 9, 9 on the flow-direction side tilt moment $M_t$ of the spar buoy, and its restoring moment $M_L$ are as represented by the following equations, where if the tilt moment $M_t$ and the restoring moment $M_L$ are approximately balanced by appropriately selecting the values of the area $A_w$ of the blades 9, the length $l_1$ of the arm 8, and the angle of attack $\alpha$, it becomes possible to restore or prevent any inclination of the spar buoy irrespectively of the flow velocity:

$$L_1 = \frac{\rho}{2} V^2 A_W C_{L1} \quad \text{[Formula 1]}$$

$$L_2 = \frac{\rho}{2} V^2 A_W C_{L2} \quad \text{[Formula 2]}$$

$$F = \frac{\rho}{2} V^2 A_B C_B \quad \text{[Formula 3]}$$

$$M_t = F \cdot l_2 \cos\theta \quad \text{[Formula 4]}$$

$$M_L = (L_1 + L_2)\cos\theta l_1 \quad \text{[Formula 5]}$$

Next, as to pitching due to waves, and rolling in the direction orthogonal to the current due to the vibromotive force of Karman vortices and flutter phenomena that will occur when water currents such as tidal currents impinge upon the spar buoy, since the blades 9 are located away from the rotational center of the yawing and also away downward from the water surface, there is exerted a damping effect, and since water molecule motions of the waves are small, so that the wave force is small, resulting in a suppressed pitching motion and no occurrence of Mode 1 (FIG. 5) and Mode 2 (FIG. 6) yawing.

The general formula for this motion is as follows:

$$(I+J)\cdot\ddot{X}+N\cdot\dot{X}+K\cdot X=M \quad (6)$$

where

X: pitching angle displacement;

$\dot{X}$: pitching angular velocity;

$\ddot{X}$: pitching angular acceleration;

I: moment of inertia of the buoy itself;

J: moment of inertia due to added mass;

N: damping coefficient linearly converted;

K: restoring force coefficient; and

M: an external force moment.

The blades 9 cause J and N to increase. In this case, M increases only a slight extent, so that the pitching momentum is small.

Also, rotational yawing about the marker mast 2 of the spar buoy is suppressed from the same reasons as in the above case, with no occurrence of yawing.

If the arm 8 is provided with a hinge 10 for folding the arm 8 at its base portion and a securing means 11 for securing the hinge 10 in a state that the arm 8 is stretched laterally, then the arm 8 can be held stretched laterally as indicated by solid line in FIG. 8 while the spar buoy is installed, by virtue of the arrangement that the hinge 10 is held secured by the securing means 11. Conversely, if the securing means 11 is released from the hinge 10, then the long arm 8 can be folded at the hinge 10 portion as indicated chain line in FIG. 8, allowing the buoy to be kept floating on the water surface as it is for towing to the installation site, thus advantageous transport.

If the overall area of the blades 9 is arranged to be variable, lifts $L_1$, $L_2$, which are one of the elements serving to restore or prevent inclination of the spar buoy, can be easily increased or decreased by appropriately selecting the area of the blades 9 after the spar buoy has been installed.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Embodiments of the present invention are described with reference to FIGS. 8 through 16.

Figure 8:
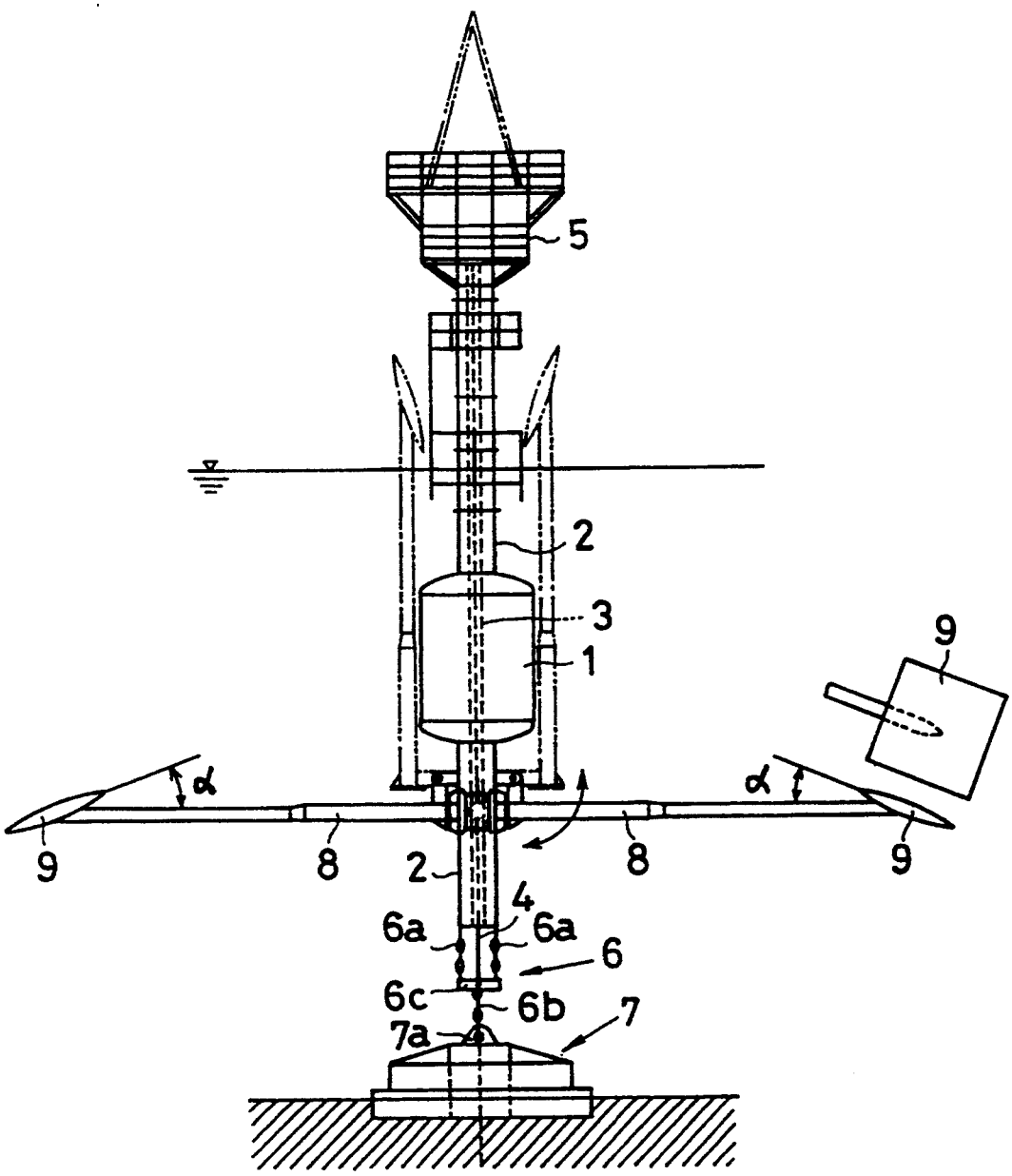
FIG. 8 is a side view more concretely showing an example of the spar buoy provided with a stabilizer of the present invention.

The stabilizer of the present invention can be applied to spar buoys for derricks, spar buoys for marker lamps, spar buoys as platforms for marine observation use or platforms for leisure use such as sea-fishing and observatories, and the like. FIG. 8 illustrates a case in which the stabilizer of the present invention is attached to a spar buoy for use of derricks.

The spar buoy for use of derricks as shown in FIG. 8 is to be used for geological surveys or boring work. In the spar buoy, a center pipe 3 is provided so as to penetrate a buoyancy body 1 and a marker mast 2, the lower end of the center pipe 3 reaching the bottom plate of the marker mast 2 to open in the water, the upper end of the center pipe 3 being located at least above the water line. The center pipe 3 has a boring pipe (e.g. a boring-use casing pipe, rod, sampler, or the like) inserted through within the center pipe 3 as designated by numeral 4. The marker mast 2 and the center pipe 3 are of double pipe construction, the exterior of the center pipe 3 being watertight and hollow so as to increase the buoyancy of the spar buoy, and the interior of the center pipe 3 allowing water to enter up to the draft line. Further, at the top of the marker mast 2 there is provided a working-use platform 5.

This spar buoy, as shown in FIG. 8, is installed in such a way that the lower end of the marker mast 2 is moored to a single sinker 7 sunk at the sea bottom by a proper mooring device 6, and the buoyancy body 1 is pulled in the water so that the water line comes halfway on the marker mast 2 which is upward of the buoyancy body 1. Then the boring pipe 4 inserted through within the center pipe 3 penetrates also the sinker 7 serving to moor the spar buoy, reaching ground G, which is the sea bottom and further extending into the ground, allowing the implementation of boring and sampling.

At least two arm 8, 8 are protruded outward in opposite directions to each other from the marker mast 2 below the buoyancy body 1 (see FIG. 8). Also, a blade 9 is attached to the end of each arm 8 so as to have a positive angle of attack $\alpha$ toward the center of the buoy.

The stabilizer of the present invention comprises at least two arms 8, 8, and the blades 9, 9 attached to the end of each arms 8, 8 so as to have a positive angle of attack $\alpha$ toward the center of the buoy referred to above.

Figure 9:
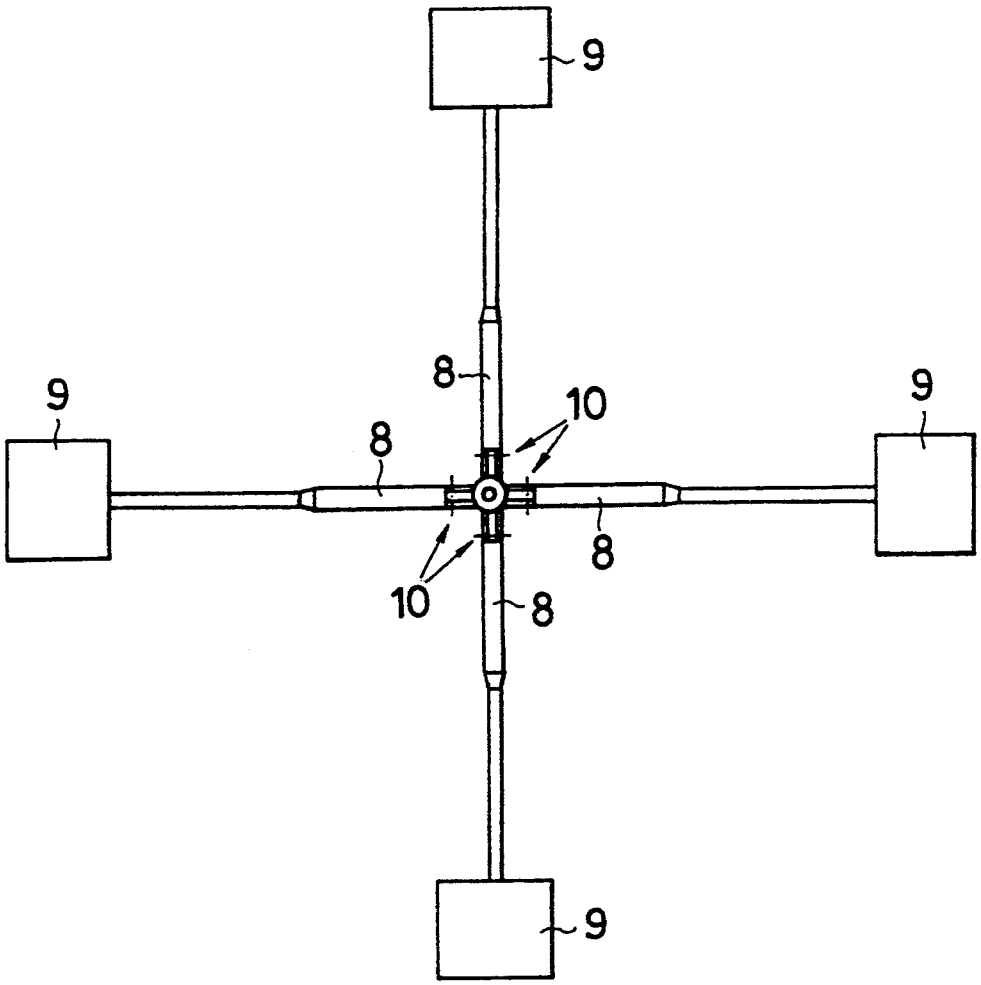
FIG. 9 is a plan view showing a state in which four arms are protruded at 90 degree intervals with respect to the marker mast and a blade is attached to the end of each arm.

The arms 8, 8 protruded in opposite directions to each other from the marker mast 2 may be at least two in number, whereas they may also be arranged four in number at 90 degree intervals with respect to the marker mast 2 as detailed on FIG. 9. Further, the number may be increased to 6, 8 and so on.

As shown in FIG. 9, a spar buoy in which four arms 8 were arranged at 90 degree intervals with respect to the marker mast 2 and a blade 9 is attached to the end of each arm 8 and a prior-art spar buoy having no such stabilizer were installed at a water depth of 18 m. With this arrangement, their effect verification test were conducted. Results are shown in FIG. 10.

Figure 10A:
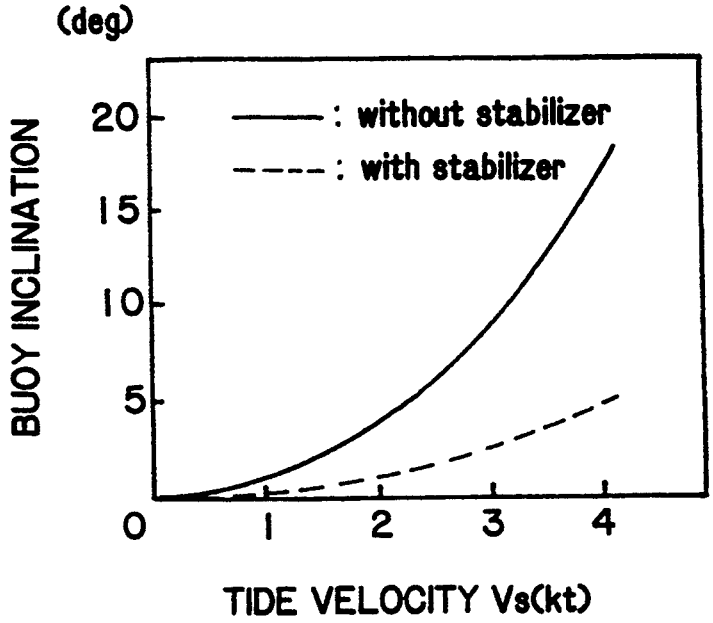
FIGS. 10*a* and 10*b* include graphs showing the result of effect verification tests on the stabilizer of the invention, FIG. 10 (*a*) shows tide-resistance characteristics and FIG. 10 (*b*) shows wave-resistance characteristics.
Figure 10B:
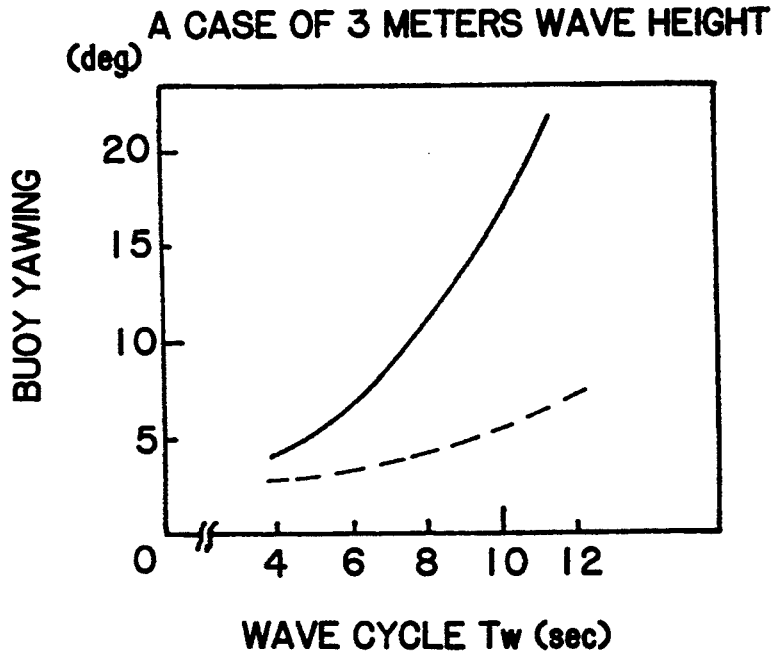

FIG. 10 (*a*) is a graph showing tide resistance characteristics, where the vertical axis represents buoy inclination (unit: degree), and the horizontal axis represents tide velocity (unit: knot). As apparent from the figure, the spar buoy provided with the invention stabilizer results in an inclination of the buoy of 1 degree at a tidal current of 2 knots. Thus, it can be understood that the inclination is substantially suppressed or prevented compared with the case in which the spar buoy has no stabilizer.

Also, FIG. 10 (*b*) is a graph showing wave resistance characteristics for a 3 m wave height, where the vertical axis represents buoy yawing (unit: degree) and the horizontal axis represents wave cycle (unit: sec.). As apparent from this figure, the spar buoy provided with the invention stabilizer results in a buoy yawing of 4 degrees at a 3 m wave height and a wave cycle of 8 sec. Thus, it can be understood that the yawing has been substantially reduced compared with the case in which the spar buoy has no stabilizer.

Figure 11:
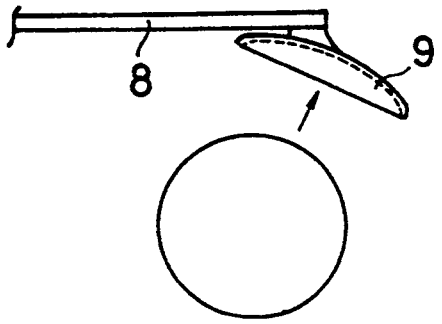
FIG. 11 is a view showing a modification of the blade.

The blade 9 as shown in FIGS. 8 and 14 through 16 is a plate rectangular as viewed planarly and streamlined at its center portion as viewed laterally, but its shape is not limited in particular. Further, a mirror plate of circular shape as viewed planarly as shown in FIG. 11 is utilized as the blade 9.

Figure 12:
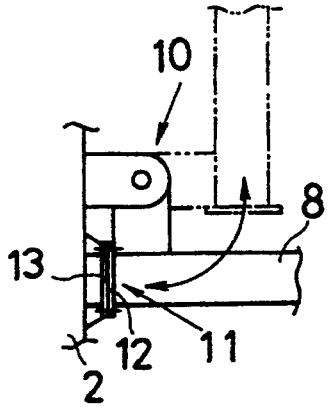
FIG. 12 is a schematic view showing examples of the mechanism for folding the arm at its base portion and the mechanism for securing the arm in its laterally stretched state.
Figure 13:
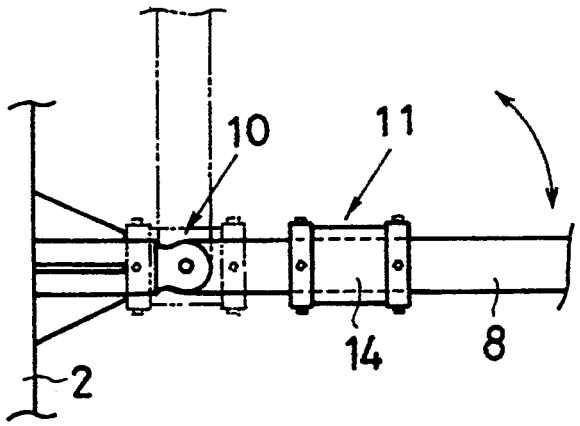
FIG. 13 is a schematic view showing another example of the mechanism as shown in FIG. 12.

The arm 8 is provided with a hinge 10 for folding it at its base portion as shown in FIGS. 12 and 13, and a securing means 11 for securing the hinge 10 in a state that the arm 8 is stretched laterally. This allows the arm 8 to be stretched laterally as indicated by solid line in each of FIGS. 8, 12, and 13, when the spar buoy is installed, by virtue of the arrangement that the hinge 10 portion is secured by the securing means 11. Conversely, if the securing means 11 is released from the hinge 10, the long arm 8 can be folded at the hinge 10 portion as indicated by chain line in each of FIGS. 8, 12, and 13. Thus, the spar buoy can be held as floating on the water surface for towing to the installation point, which is advantageous in transport.

The securing means 11 as shown in FIG. 12 is of the so-called flange type in which a securing plate 12 such as a liner is fixed at the base of the arm 8 by welding while another securing plate 13 is fixed also on the marker mast 2 side by welding, both securing plates 12, 13 being brought into contact and fixed by fixing devices such as bolt and nut. If it is arranged that the securing plates 12, 13 are in contact with each other with the arm 8 stretched laterally, the arm 8 can be held stretched laterally from the marker mast 2 only by fixing both the securing plates 12, 13 by fixing devices. Conversely, if the fixing devices are released, the securing state can be released, allowing the arm 8 to be folded at the hinge 10 portion as indicated by chain line.

Further, the securing means 11 as shown in FIG. 13 is of the color type in which a cylindrical body 14 is fitted on the outer periphery of the arm 8. If the cylindrical body 14 is slid so as to come to the outer portion of the hinge 10 as indicated by chain line, the arm 8 can be held stretched laterally from the marker mast 2. Conversely, if the cylindrical body 14 is slid as indicated by solid line from the position indicated by chain line, the above fixed state can be released, allowing the arm 8 to be folded at the hinge 10 portion as indicated by chain line.

It is noted that the means for securing the hinge 10 so that the arm 8 is stretched laterally has been exemplified by referring to two cases, but the securing means is not limited only to these.

On the other hand, the blade 9 attached to the end of the arm 8 is preferably variable in its overall area. This is to allow the lifts $L_1$, $L_2$, which are one of the elements for restoring or preventing the spar buoy from its inclination, to be easily increased and decreased after the spar buoy has been installed.

Figure 14:
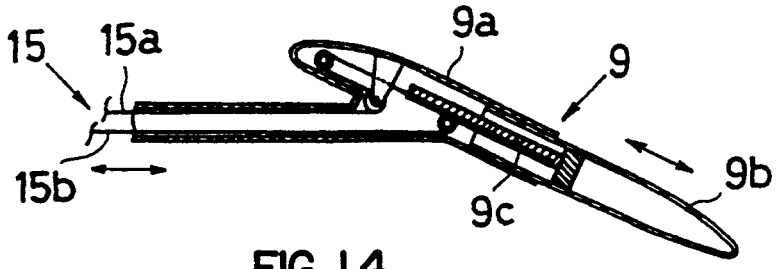
FIG. 14 is a schematic view showing an example of the mechanism that allows the blade to be variable in its area.
Figure 15:
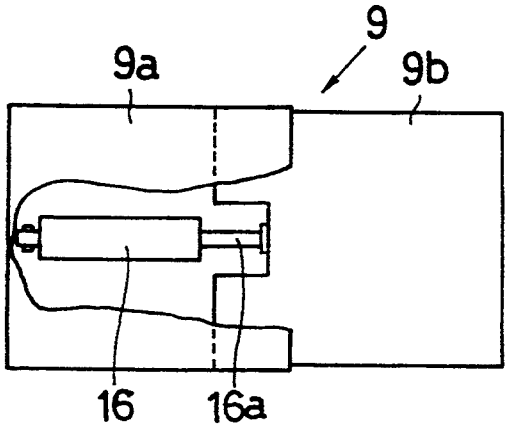
FIG. 15 is a schematic view showing another example of the mechanism as shown in FIG. 14.
Figure 16A:
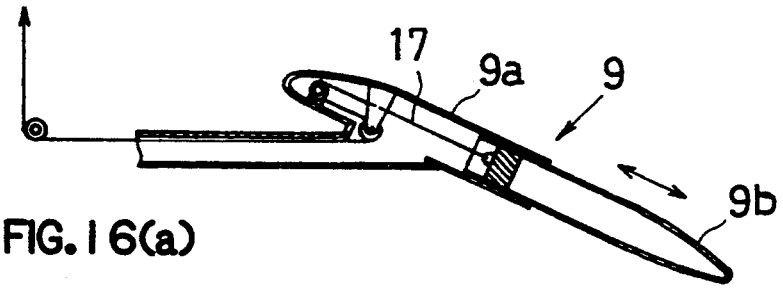
FIGS. 16*a* and 16*b* are schematic views showing yet other examples of the mechanism other than shown in FIGS. 14 and 15.
Figure 16B:
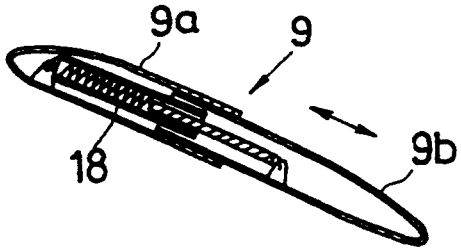

To make the blade 9 variable in its area, it is proper to divide the blade 9 into two sheets as designated by 9*a*, 9*b* so that with respect to a sheath-like blade 9*a* another blade 9*b* can be slid, as shown in FIGS. 14 to 16.

In order that the blade 9*b* is slid with respect to the sheath-like blade 9*a*, it is proper that one wire 15 is arranged within the sheath-like blade 9*a* and within the hollow arm 8, and a halfway point thereof is secured to a rod 9*c* of the other blade 9*b*, for example as shown in FIG. 14. Pulling either one of inner portions 15*a*, 15*b* of the wire 15 allows the blade 9*b* to be slid with respect to the sheath-like blade 9*a*, so that the overall area of the blade 9 can be easily changed.

Further, the blade 9*b* can be slid with respect to the sheath-like blade 9*a* also by securing a cylinder 16 on the sheath-like blade 9*a* side and securing its rod 16*a* on the other blade 9*b* side, as shown in FIG. 15. That is, by remotely controlling the cylinder 16, the blade 9*b* can be slid with respect to the sheath-like blade 9*a*, allowing the blade 9 to be changed in its overall area.

Further, the blade 9*b* can be slid with respect to the sheath-like blade 9*a* also by combining a wire 17 and a spring 18 as shown in FIG. 16. That is, one wire 17 is arranged within the sheath-like blade 9*a* and within the hollow arm 8 as shown in FIG. 16 (*a*), and its outer end (right-hand end in the figure) is secured to the other blade 9*b* while springs 18, 18 are interposed between the blades 9*a*, 9*b* corresponding to right and left sides with respect to the wire 17 as shown in FIG. 16 (*b*). Pulling the inner side of the wire 17 allows the blade 9*b* to slide and go into the sheath-like blade 9*a* against the urging force of the spring 18. Conversely, loosening the wire 17 allows the blade 9*b* to slide and go out of the sheath-like blade 9*a* by the urging force of the spring 18. By this arrangement, the blade 9 can be easily changed in its overall area.

Figure 1:
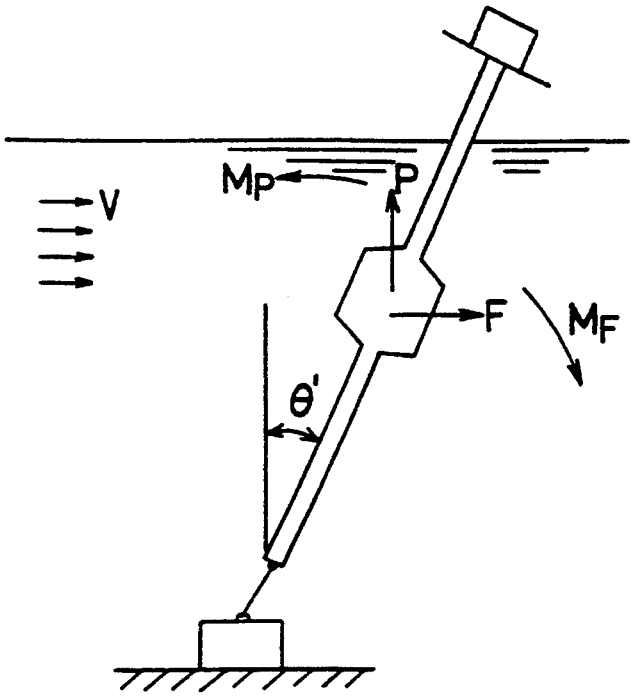
FIG. 1 PRIOR ART
FIG. 1 is a side view showing a state in which a prior-art spar buoy is installed in water current.
Figure 2:
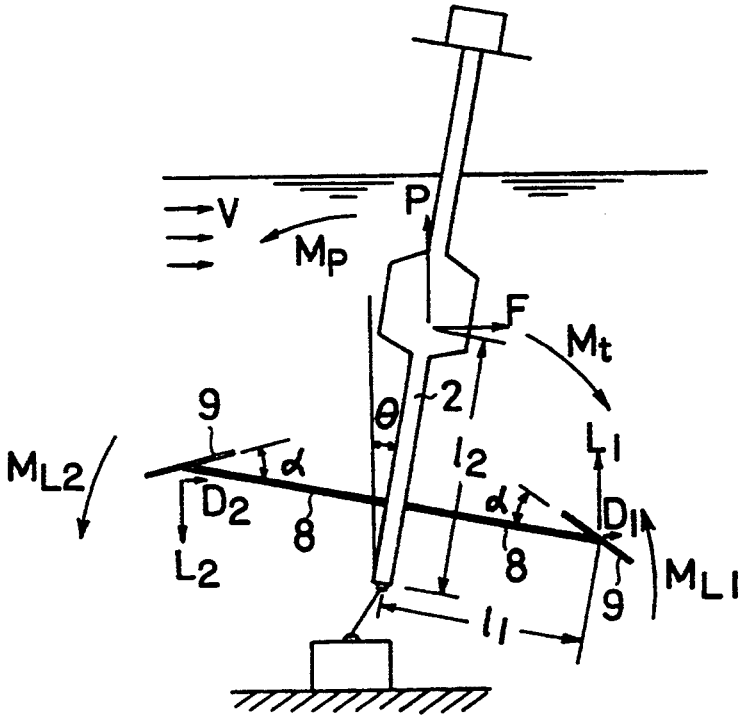
FIG. 2 is a side view showing a state in which a spar buoy provided with an stabilizer according to the present invention is installed in a water current.
Figure 3:
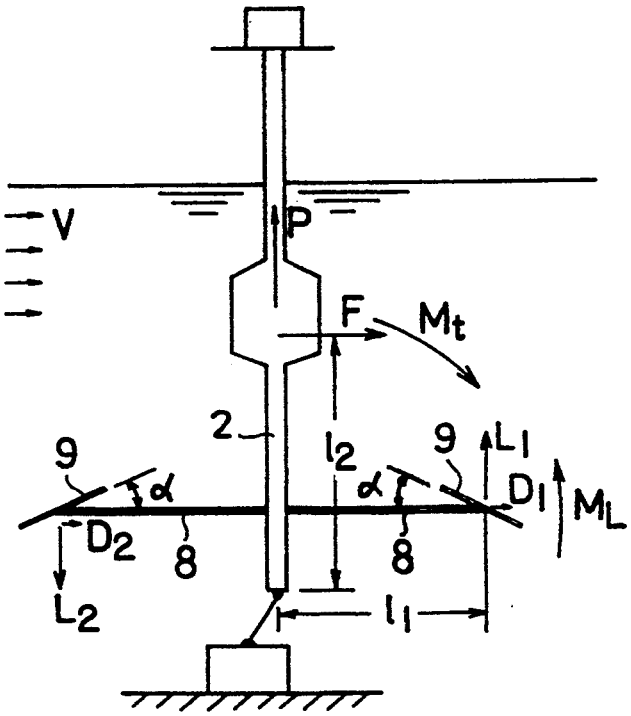
FIG. 3 is a side view showing a state in which the spar buoy provided with the stabilizer of the invention is perfectly stabilized in its erected state in a water current.
Figure 4:
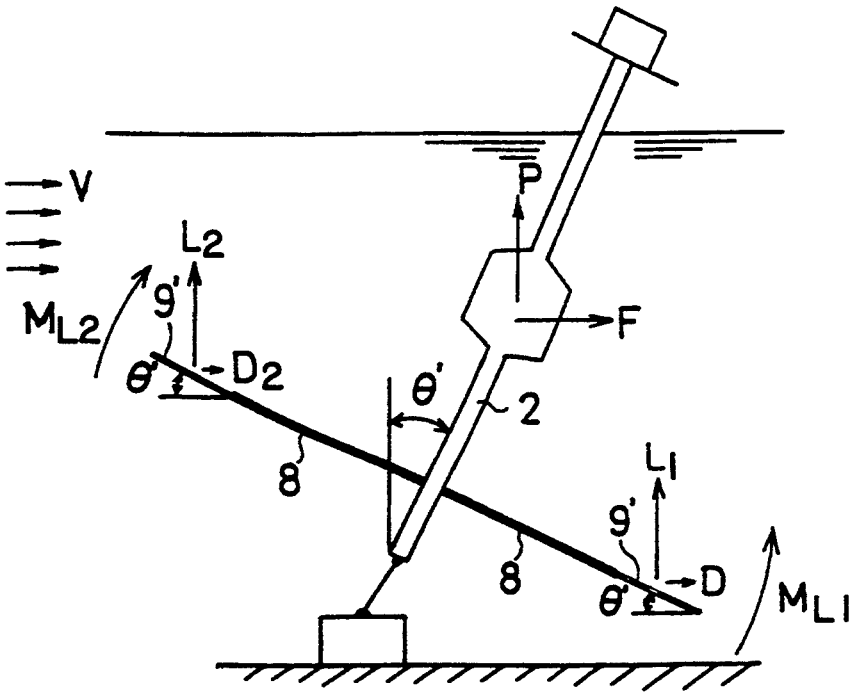
FIG. 4 is a side view showing a state in which a spar buoy having blades attached thereto without providing an angle of attack to the arms is installed in a water current.
Figure 5:
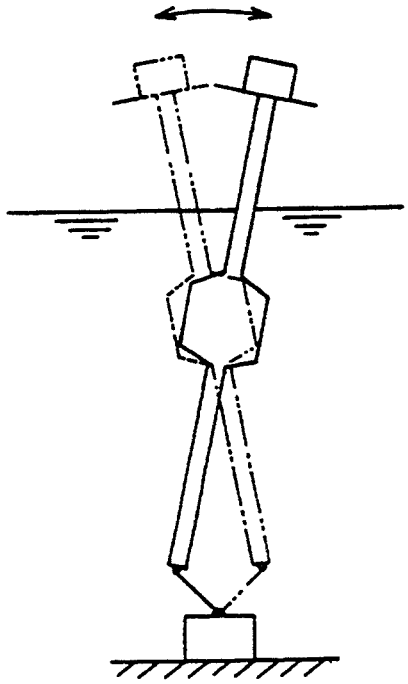
FIG.5 PRIOR ART
FIG. 5 is a side view for explaining the yawing about the spar buoy's center of gravity.
Figure 6:
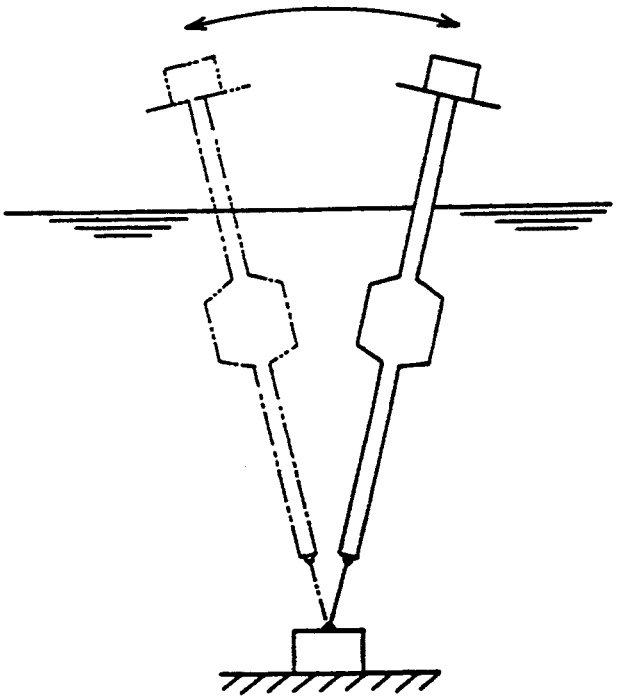
FIG.6 PRIOR ART
FIG. 6 is a side view for explaining the yawing about the spar buoy's mooring point.
Figure 7:
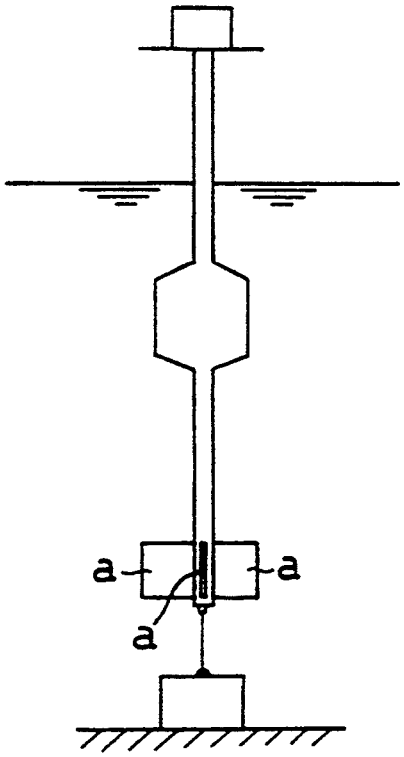
FIG. 7 PRIOR ART
FIG. 7 is a side view for explaining the prior-art example for suppressing the yawing about the spar buoy's center of gravity.

It should be noted that the mooring device designated by number 6 in FIG. 8 comprises two mooring ropes 6*a*, 6*a* attached to two points of the lower end of the marker mast 2 in the radial direction via a shackle, two mooring ropes 6*b*, 6*b* attached to two mooring rings 7*a*, 7*a* of the sinker 7 sunk at the sea bottom at two points planarly 90 degrees away from the two mooring ropes 6*a*, 6*a* via a shackle, and one mooring ring 6*c* for indirectly coupling the mooring ropes 6*a*, 6*a*, and 6*b*, 6*b*, each two in number for upper and lower ropes. When such a mooring device is used, the spar buoy installed in the seas shallower than 20 m in water depth result in a smaller natural period of Mode 2 (yawing as shown in FIG. 6), approaching the wave period of design conditions (e.g. 8–12 sec.) to enter the resonance range, in which case yawing may be increased.

According to the present invention as claimed in claim 1, there is offered an advantage that the spar buoy can be easily suppressed or prevented from inclination due to water-current resistance when installed, while the spar buoy can also be suppressed from Mode 1 and Mode 2 yawing as well as such yawing that the spar buoy turns about its center axis.

According to the present invention as claimed in claim 2, there is offered another advantage that since the long arm 8 can be folded at the hinge 10 portion, the spar buoy can be held as floating on the water surface for towing to an installation point, which is highly advantageous in terms of transport.

According to the present invention as claimed in claim 3, there is offered a further advantage that the spar buoy can be easily adjusted so as to be suppressed or prevented from inclination, only as required, by selecting the area of the blade 9 after the spar buoy has been installed, which allows the structure to be downsized.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A stabilizer for a spar buoy having a column moored at a bottom end of the column to a sinker sunk at a water floor by a mooring device for pulling a buoy provided halfway of the column into the water so that the water line comes halfway of the column above the buoy, said stabilizer for a spar buoy comprising:

at least two arms extending in opposite directions to each other from the column below the buoy; and blades arranged at end portions of the arms so that the blades incline downward from inner edges of blades to outer edges thereof with respect to the arms, thereby making angles $\alpha$ between the arms and the blades.

2. A stabilizer for a spar buoy as claimed in claim 1, wherein the overall area of the blade (9) is variable.

3. A stabilizer for a spar buoy as claimed in claim 1, wherein the arm comprises a hinge for folding the arm at a base portion of the arm, and a securing means for securing the hinge so that the arm is stretched in an orthogonal direction to the column.

4. A stabilizer for a spar buoy having a column moored at a bottom end of the column to a sinker sunk at a water floor by a mooring device for pulling a buoy provided halfway of the column into the water so that the water line comes halfway of the column above the buoy, said stabilizer for a spar buoy comprising:

at least two arms extending in opposite directions to each other from the column below the buoy, said arms comprising a hinge for folding the arm at a base portion of the arm and a securing means for securing the hinge so that the arm is stretched in an orthogonal direction to the column; and blades attached to end portions of the arms, making a prescribed angle $\alpha$ between the blades and the arms toward the center of the buoy.

* * * * *